US011891776B2

(12) United States Patent
Yamada et al.

(10) Patent No.: US 11,891,776 B2
(45) Date of Patent: Feb. 6, 2024

(54) AUTOMATIC OPERATION WORK MACHINE

(71) Applicant: Hitachi Construction Machinery Co., Ltd., Tokyo (JP)

(72) Inventors: Hiroyuki Yamada, Tokyo (JP); Yoshiyuki Tsuchie, Tokyo (JP); Shiho Izumi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 422 days.

(21) Appl. No.: 17/419,366

(22) PCT Filed: Feb. 14, 2020

(86) PCT No.: PCT/JP2020/005897

§ 371 (c)(1),
(2) Date: Jun. 29, 2021

(87) PCT Pub. No.: WO2020/179415

PCT Pub. Date: Sep. 10, 2020

(65) Prior Publication Data

US 2022/0074168 A1 Mar. 10, 2022

(30) Foreign Application Priority Data

Mar. 5, 2019 (JP) ..... 2019-039782

(51) Int. Cl.
*E02F 9/20* (2006.01)
*E02F 9/26* (2006.01)
(Continued)

(52) U.S. Cl.
CPC ..... *E02F 9/2041* (2013.01); *E02F 9/123* (2013.01); *E02F 9/262* (2013.01); *E02F 9/265* (2013.01);
(Continued)

(58) Field of Classification Search
CPC ..... E02F 9/2041; E02F 9/123; E02F 9/262; E02F 9/265; E02F 3/32; E02F 3/439;
(Continued)

(56) References Cited

U.S. PATENT DOCUMENTS

2008/0133093 A1 6/2008 Stanek et al.
2008/0263908 A1* 10/2008 Schoenmaker ..... E02F 3/434 711/100

(Continued)

FOREIGN PATENT DOCUMENTS

JP 8-84675 A 4/1996
JP 2000-291077 A 10/2000
JP 2001-90120 A 4/2001

OTHER PUBLICATIONS

International Preliminary Report on Patentability (PCT/IB/338 & PCT/IB/373) issued in PCT Application No. PCT/JP2020/005897 dated Sep. 16, 2021, including English translation of document C2 (Japanese-language Written Opinion (PCT/ISA/237), filed on Jun. 29, 2021) (six (6) pages).

(Continued)

*Primary Examiner* — Hussein Elchanti
*Assistant Examiner* — Kenneth M Dunne
(74) *Attorney, Agent, or Firm* — Crowell & Moring LLP

(57) ABSTRACT

When an automatic operation is finished, a detection process for detecting a ground contactable range where a work implement can be set is carried out on a basis of terrain profile information acquired by laser scanners, and, when the ground contactable range is detected, an automatic operation command signal for placing the work implement in contact with the ground contactable range is generated, whereas when the ground contactable range is not detected, an automatic operation command signal for placing the work implement in a predetermined standby posture is generated.

(Continued)

As a result, a suitable standby posture can be taken according to the surrounding conditions when the automatic operation is finished.

4 Claims, 7 Drawing Sheets

(51) Int. Cl.

| | |
|---|---|
| ***E02F 3/32*** | (2006.01) |
| ***E02F 3/43*** | (2006.01) |
| ***E02F 9/12*** | (2006.01) |
| *E02F 9/22* | (2006.01) |

(52) U.S. Cl.
CPC ..... *E02F 3/32* (2013.01); *E02F 3/439* (2013.01); *E02F 9/2004* (2013.01); *E02F 9/2271* (2013.01); *E02F 9/2285* (2013.01); *E02F 9/2292* (2013.01); *E02F 9/2296* (2013.01)

(58) Field of Classification Search
CPC ..... E02F 9/2004; E02F 9/2271; E02F 9/2285; E02F 9/2292; E02F 9/2296
See application file for complete search history.

(56) References Cited

U.S. PATENT DOCUMENTS

| | | | | |
|---|---|---|---|---|
| 2016/0312446 | A1* | 10/2016 | Pettersson | H04N 7/181 |
| 2020/0165799 | A1* | 5/2020 | Wu | E02F 9/262 |
| 2022/0195705 | A1* | 6/2022 | Krause | E02F 9/2041 |

OTHER PUBLICATIONS

International Search Report (PCT/ISA/210) issued in PCT Application No. PCT/JP2020/005897 dated Apr. 21, 2020 with English translation (four (4) pages).
Japanese-language Written Opinion (PCT/ISA/237) issued in PCT Application No. PCT/JP2020/005897 dated Feb. 21, 2020 (three (3) pages).

* cited by examiner

AUTOMATIC OPERATION WORK MACHINE

TECHNICAL FIELD

The present invention relates to an automatic operation work machine capable of operating on an unmanned basis.

BACKGROUND ART

In recent years, automation of a work machine, like automobiles, has been progressed, and a so-called machine control technology of automatically adjusting the operation of a work implement attendant on an operation by the operator along a predetermined target surface has been developed. In addition, with the progress of such automation technology, a work machine (automatic operation work machine) capable of automatic operation by which part of the work is performed on an unmanned basis without need for the operator's operation has been developed.

As a technology concerning such an automatic operation work machine, for example, Patent Document 1 discloses an automatic operation excavator in which a plurality of positions are taught and stored by a teaching operation, and which automatically repeat a series of operations from excavation to soil dropping on the basis of the plurality of positions stored by a regeneration operation. The automatic operation excavator includes teaching position storage means for storing the positions of at least an excavation position, a soil dropping position and a standby position as the plurality of positions taught by the teaching operation and stored, and standby operation processing means that, when movement to the standby position is commanded, determines the operation state of the automatic operation excavator from among the series of operations from excavation to soil dropping, and places the automatic operation excavator in a predetermined standby position by performing a predetermined standby operation according to the respective operation states.

PRIOR ART DOCUMENT

Patent Document

Patent Document 1: JP-2001-90120-A

SUMMARY OF THE INVENTION

Problem to be Solved by the Invention

Such an automatic operation work machine performs a specific work automatically for a predetermined time, during which an operator's operation is not needed; therefore, after giving an instruction to perform a work and starting an automatic operation, the operator is not required to be riding on the work machine, and can engage with other work at another place. In addition, the automatic operation work machine, when the work on which an instruction has been given is finished or when the work cannot be completed for some reason, finishes the automatic operation, and remain in a standby state until a next automatic operation instruction or an operation by riding of the operator is given.

When the automatic operation work machine thus finishes the automatic operation and remains standby, the standby posture of the work machine is important; it is desirable that the standby posture is a state in which the machine body is as stable as possible, and change-over from the unmanned state to the operator's operation state should be taken into consideration.

In the above-mentioned prior art, in the case in which a standby command is issued when the automatic operation is finished or the like time, the excavator is caused to automatically perform a predetermined standby operation, and, when the operator rides on or gets off the excavator, the excavator is automatically moved to a position where the operator can ride on or gets off the excavator easily (hereinafter the position will be referred to as the standby position), and the excavator is put in a standby state by being caused to take a predetermined standby posture which is a stable posture and is suitable for easy securement of safety at the time when the operator rides on or gets of the excavator.

However, the standby posture in the above-mentioned prior art is preset one, and there may be cases, depending on the surrounding conditions, where the preset standby posture is unsuitable or the standby posture cannot be taken.

The present invention has been made in consideration of the aforementioned, and it is an object of the present invention to provide an automatic operation work machine capable of being caused to take a suitable standby posture according to the surrounding conditions when the automatic operation is finished.

Means for Solving the Problem

The present application include a plurality of means for solving the above problem, and one example thereof is an automatic operation work machine including a machine main body, a work implement mounted on the machine main body, an operation device that operates the work implement, an actuator that drives the work implement on the basis of a manual operation command signal generated by an operation of the operation device, a posture information measuring device that acquires posture information which is information concerning posture of the work implement, and an automatic operation controller that generates an automatic operation command signal substituting for the manual operation command signal, and performs automatic operation for permitting the work implement to automatically perform a predetermined operation on the basis of the automatic operation command signal generated, wherein the automatic operation work machine further includes a terrain profile information measuring device that acquires terrain profile information surrounding the automatic operation work machine, and the automatic operation controller, when the automatic operation is finished, performs a detection process for detecting a ground contactable range in which the work implement can be placed on the basis of the terrain profile information acquired by the terrain profile measuring device, and, when the ground contactable range is detected, the automatic operation controller generates an automatic operation command signal to place the work implement in contact with the ground contactable range, whereas when the ground contactable range is not detected, the automatic operation controller generates an automatic operation command signal to place the work implement in a predetermined standby posture.

Advantages of the Invention

According to the present invention, automatic work can be suitably continually performed according to communication performance of a communication network, and work efficiency of a work machine can be enhanced.

MODES FOR CARRYING OUT THE INVENTION

Figure 1:
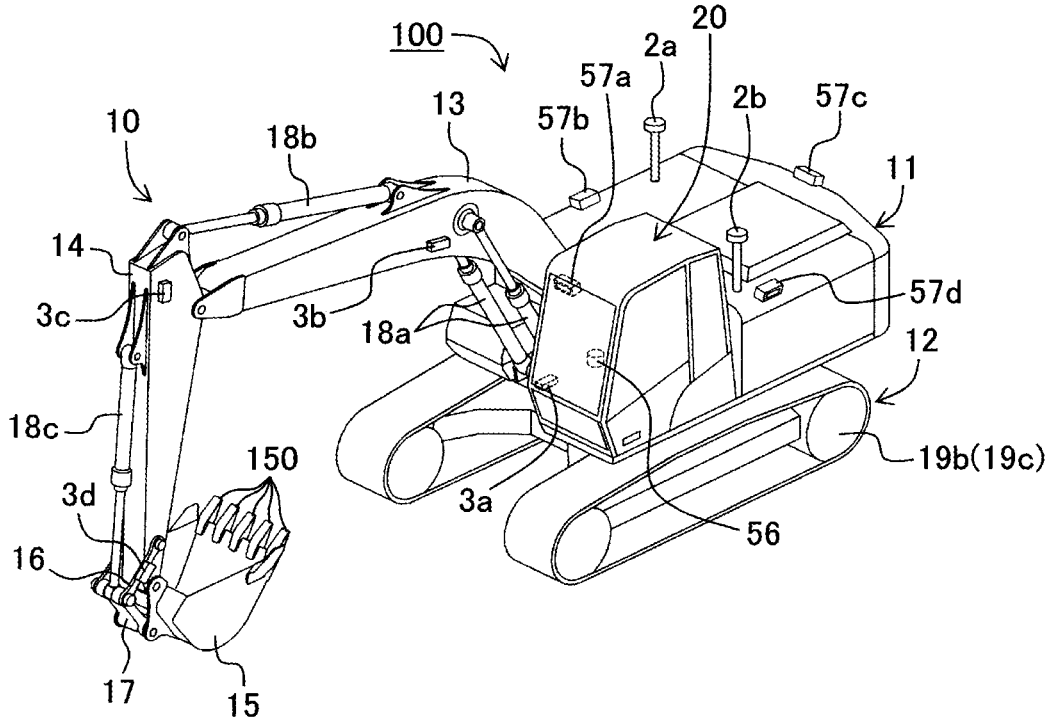
FIG. 1 is an external appearance view schematically depicting the external appearance of a hydraulic excavator as an example of an automatic operation work machine according to a first embodiment.

Embodiments of the present invention will be described below referring to the drawings.

Note that while in the present embodiment, description will be made by showing a hydraulic excavator including a front device (work implement) as an example of an automatic operation work machine, the present invention is applicable also to other automatic operation work machines including a work implement, such as a wheel loader and bulldozer.

In addition, in the following description, when the same configuration elements are present, characters (numerals) may be suffixed with an alphabet, but the alphabet may be omitted to denote the plurality of configuration elements collectively. For example, where four posture information measuring devices 3*a*, 3*b*, 3*c* and 3*d* are present, they may be denoted collectively as posture information measuring devices 3.

First Embodiment

A first embodiment of the present invention will be described referring to FIGS. 1 to 9.

FIG. 1 is an external appearance view depicting schematically an external appearance of a hydraulic excavator as an example of an automatic operation work machine according to the present embodiment. In addition, FIG. 2 is a schematic view depicting an example of a machine control system mounted on the automatic operation work machine, in the state of being extracted together with related configurations such as a hydraulic circuit system, and FIG. 3 is a diagram depicting the details of processing functions of a machine controller and an automatic operation controller.

Figure 2:
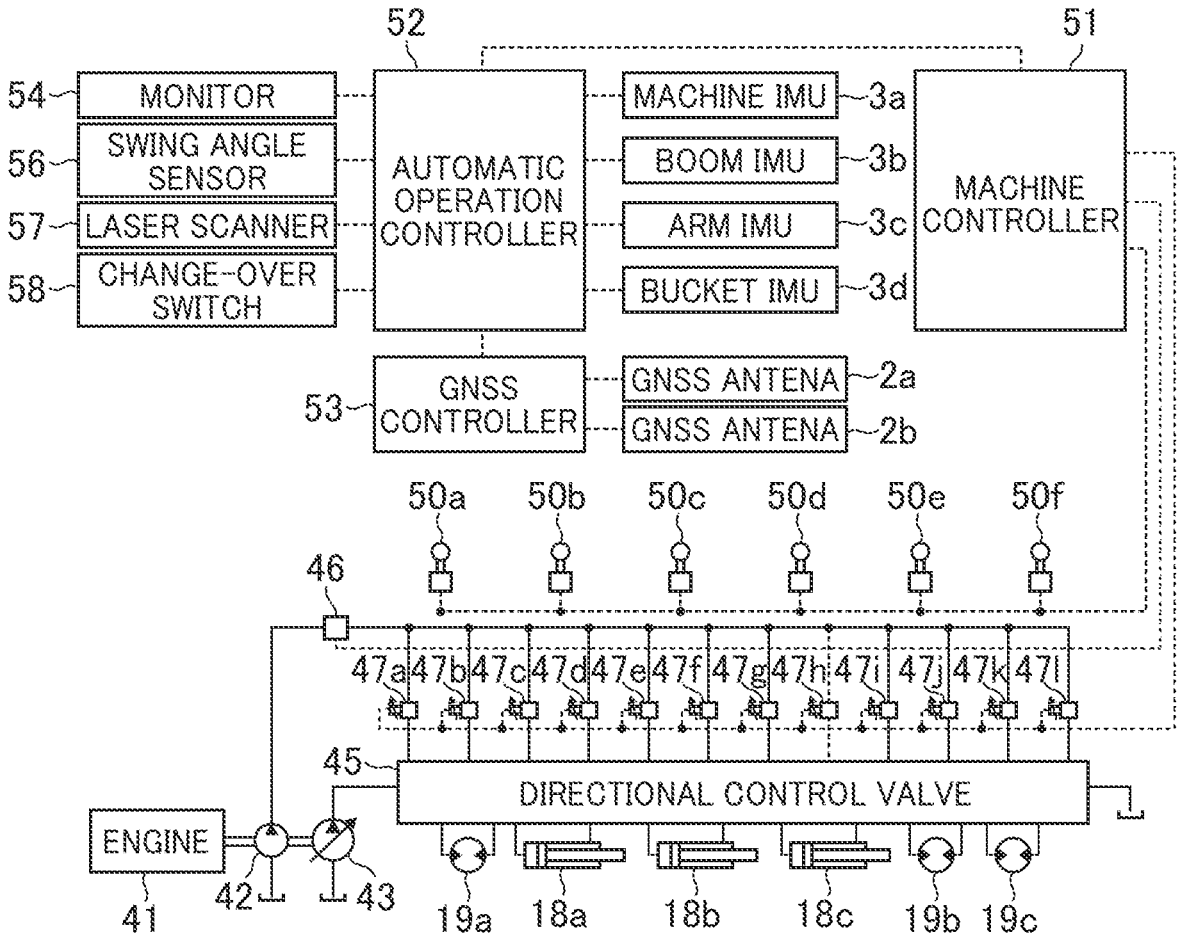
FIG. 2 is a schematic view depicting an example of a machine control system mounted on the automatic operation work machine, in a state of being extracted together with relates configuration such as a hydraulic circuit system.
Figure 3:
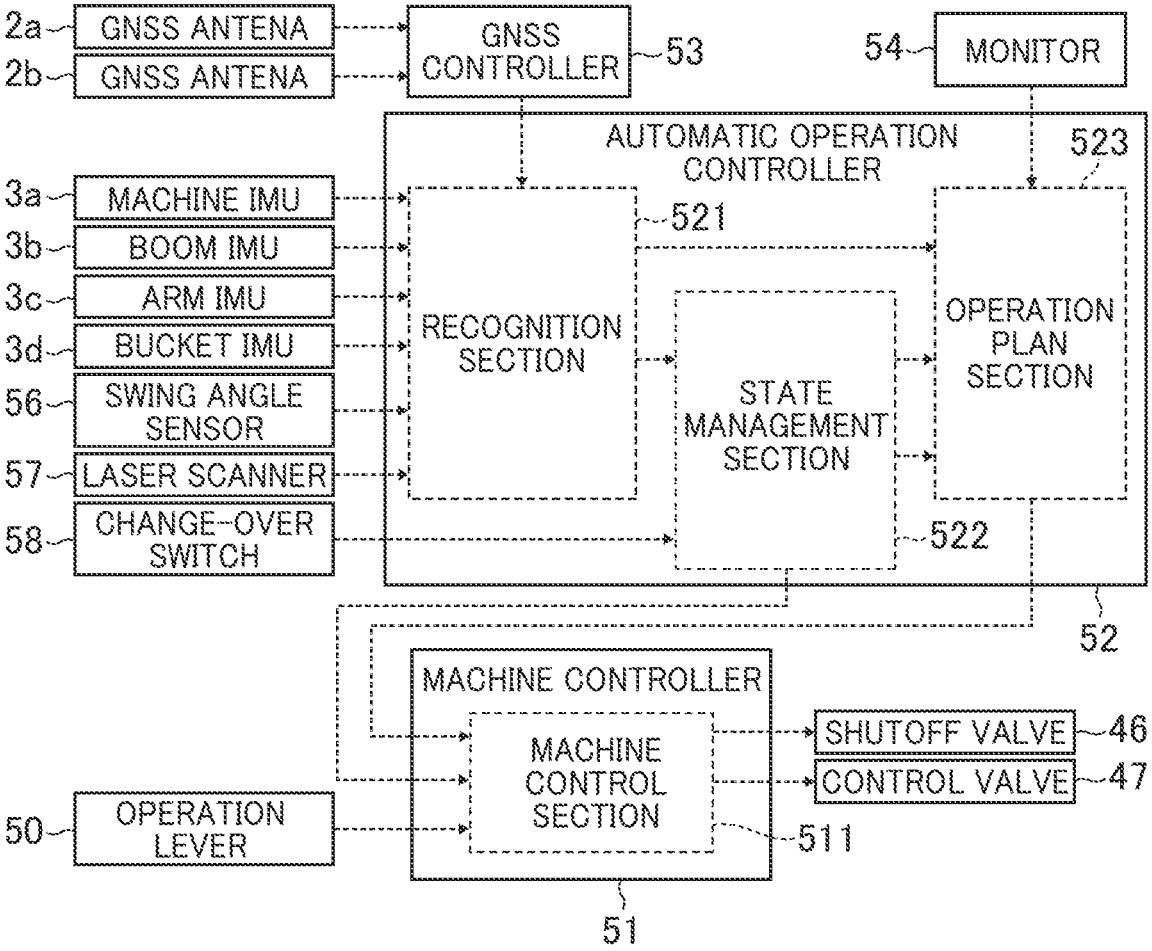
FIG. 3 is a diagram depicting the details of processing functions of a machine controller and an automatic operation controller.

In FIGS. 1 to 3, a hydraulic excavator 100 includes an articulated type work implement 10 including a plurality of front members (a boom 13, an arm 14, a bucket 15) coupled together and rotated independently in the vertical direction, and an upper swing structure 11 and a lower track structure 12 constituting a machine main body, the upper swing structure 11 being provided swingably relative to the lower track structure 12.

A base end of the boom 13 of the work implement 10 is supported on a front portion of the upper swing structure 11 so as to be rotatable in the vertical direction, one end of the arm 14 is supported on an end (tip end) different from the base end of the boom 13 so as to be rotatable in the vertical direction, and the bucket 15 is supported on the other end of the arm 14 so as to be rotatable in the vertical direction. The front members (the boom 13, the arm 14 and the bucket 15) are driven respectively by a boom cylinder 18*a*, an arm cylinder 18*b*, and a bucket cylinder 18*c* which are hydraulic actuators. Note that in the following description, the boom cylinder 18*a*, the arm cylinder 18*b* and the bucket cylinder 18*c* may be expressed collectively as hydraulic cylinders 18.

Bucket links 16 and 17 constituting a four-joint link mechanism together with the arm 14 and the bucket 15 are provided between the arm 14 and the bucket 15 of the work implement 10. One end of the bucket link 16 is rotatably supported on the arm 14, the other end is rotatably supported on one end of the bucket link 17, and the other end of the bucket link 17 is rotatably supported on the bucket 15. According to contraction and extension of the bucket cylinder 18*c* having one end rotatably supported on the arm 14 and having the other end rotatably supported on the bucket link 16, the bucket link 16 constituting the four-joint link mechanism is rotationally driven relative to the arm 14, and, in conjunction with the rotational driving of the bucket link 16, the bucket 15 constituting the four-joint link mechanism is rotationally driven relative to the arm 14.

The lower track structure 12 is provided with track hydraulic motors 19*b* and 19*c* (including a velocity-reducing mechanism not illustrated) that respectively drive a pair of left and right crawlers. Note that in FIG. 1, only one of the pair of left and right track hydraulic motors 19*b* and 19*c* provided on the lower track structure 12 is illustrated and denoted by a character, whereas the other configuration is omitted from illustration by only indicating a parenthesized character in the figure. The upper swing structure 11 is swingingly driven relative to the lower track structure 12 by a swing hydraulic motor 19*a* (see FIG. 2), and the pair of left and right crawlers of the lower track structure 12 are driven respectively by the left and right track hydraulic motors 19*b* and 19*c*. At a swing driving section between the upper swing structure 11 and the lower track structure 12, a swing angle sensor 56 that measures the swing angle of the upper swing structure 11 relative to the lower track structure 12 is disposed. Note that in the following description, the swing hydraulic motor 19*a* and the track hydraulic motors 19*b* and 19*c* may be collectively referred to as the hydraulic motors 19.

The machine main body is moved to a desired position by driving the track hydraulic motors 19*b* and 19*c* of the hydraulic excavator 100 configured as above, the upper swing structure 11 is swingingly driven in a desired direction by driving the swing hydraulic motor 19*a*, and, by driving the boom cylinder 18*a*, the arm cylinder 18*b* and the bucket cylinder 18*c* to proper positions, the bucket 15 provided at the tip end of the work implement 10 is driven to an optional position and posture, to perform a desired work such as excavation.

Posture information measuring devices 3*a* to 3*d* that acquire posture information which is information concerning posture are attached respectively to the upper swing structure 11, the boom 13 and the arm 14 of the work implement 10, and the bucket link 16 of the bucket 15. The posture information indicates inclination angles and inclination directions of the members to which the posture information measuring devices 3*a* to 3*d* are attached, and is indicated, for example, relative to a horizontal plane or relative to other member. In the present embodiment, a case in which IMUs (Inertial Measurement Units) are used as the posture information measuring devices 3*a* to 3*d* is shown as an example in the description. The posture information measuring devices 3*a* to 3*d* output measured values of accelerations and angular velocities in an IMU coordinate system set for each of the posture information measuring devices 3*a* to 3*d*, as posture information. Since gravitational acceleration is always vertical to a horizontal plane, by use of these measured values and the information concerning the attached state of the posture information measuring devices 3*a* to 3*d* (namely, relative positional relations between the posture information measuring devices 3*a* to 3*d* and the upper swing structure 11, the boom 13, the arm 14 and the bucket link 16), the inclination angles and inclination directions relative to a horizontal plane of the upper swing structure 11 and each front member (the boom 13, the arm 14, and the bucket 15) of the work implement 10 can be acquired, and self-posture can be known. Particularly, in regard of the bucket 15 constituting the four-joint link mechanism, rotational posture can be known on the basis of not only the measurement result from the posture information measuring device 3*d* provided on the bucket link 16 but also the measurement result from the posture information measuring device 3*c* provided on the arm 14 and dimensional information of the four-joint link mechanism. Note that in the present embodiment, the case of using the IMUs as the posture information measuring devices is shown in the description, but this is not limitative, and a potentiometer, a cylinder stroke sensor and the like may be used insofar as similar information can be obtained.

In addition, a cab 20 in which an operator rides to perform operation of the hydraulic excavator 100 is disposed at a front portion of the upper swing structure 11 and at a lateral side (in the present embodiment, left side) of a support portion of the base end of the boom 13 of the work implement 10. An arm operation lever 50*a*, a boom operation lever 50*b* and a bucket operation lever 50*c* as operation devices for operating the work implement 10, a swing operation lever 50*d* as an operation device for operating a swing operation of the upper swing structure 11, and track operation levers 50*e* and 50*f* as track operation devices for operating a track operation of the lower track structure 12 are disposed in the cab 20 (see FIG. 2). Note that in the following description, the above-mentioned operation levers 50*a* to 50*f* may be collectively referred to as operation levers 50. The operation levers 50 output a voltage or a current according to the operation amount of the lever, are electrically connected to a machine controller 51 (see FIG. 2), and the operation amount of each of the operation levers 50 can be read by the machine controller 51.

On the upper swing structure 11, not only the machine controller 51 constituting a machine control system, an automatic operation controller 52, a GNSS controller 53, and the like, but also an engine 41 as a prime mover, a fixed displacement pilot hydraulic pump 42 and a variable displacement main hydraulic pump 43 that are driven by the engine 41, a directional control valve 45 that controls the direction and flow rate of a hydraulic working oil delivered from the main hydraulic pump 43 and supplied to the hydraulic actuators such as the boom cylinder 18*a*, the arm cylinder 18*b*, the bucket cylinder 18*c*, the swing hydraulic motor 19*a* and the left and right track hydraulic motors 19*b*, 19*c*, and control valves 47*a* to 47*l* that generate a pilot pressure for controlling the directional control valve 45 from a delivery pressure of the pilot hydraulic pump 42 on the basis of a control signal from the machine controller 51 are disposed, and these constitute a hydraulic circuit system. Note that in the following description, the control valves 47*a* to 47*l* may be collectively referred to as control valves 47.

The pilot hydraulic pump 42 and the main hydraulic pump 43, by being driven by the engine 41, supply a hydraulic working oil into the hydraulic circuit. Here, the oil supplied by the pilot hydraulic pump 42 is referred to a pilot oil, whereas the oil supplied by the main hydraulic pump 43 is referred to as a hydraulic working oil, on a distinguishing basis. The pilot oil supplied from the pilot hydraulic pump 42 is sent to the directional control valve 45 through the shutoff valve 46 and the control valve 47. The shutoff valve 46 and the control valved 47 are electrically connected to the machine controller 51, and the valve opening and closing of the shutoff valve 46 and the valve opening degree of the control valve 47 are controlled by control signals from the machine controller 51.

The directional control valve 45 controls the amount and direction of the hydraulic working oil supplied from the main hydraulic pump 43 to each hydraulic cylinder 18 and each hydraulic motor 19, and according to the pilot oil passed through the control valve 47, how much hydraulic working oil is to be made to flow to which one of the hydraulic cylinders 18 or which one of the hydraulic motor 19 and in which direction is controlled. Specifically, according to the pilot oil sent to the directional control valve 45 through the control valve 47*a*, such an amount of the hydraulic working oil as to drive the hydraulic cylinder 18*b* to one of extension and contraction is determined in the directional control valve 45, and according to the pilot oil sent to the directional control valve 45 through the control valve 47*b*, such an amount of the hydraulic working oil as to drive the hydraulic cylinder 18*b* to the other of extension and contraction is determined in the directional control valve 45.

Similarly, an amount of the hydraulic working oil for driving the hydraulic cylinder 18*a* according to the pilot oil passed through the control valves 47*c* and 47*d*, an amount of the hydraulic working oil for driving the hydraulic cylinder 18*c* according to the pilot oil passed through the control valves 47*e* and 47*f*, an amount of the hydraulic working oil for driving the swing hydraulic motor 19*a* according to the pilot oil passed through the control valves 47*g* and 47*h*, an amount of the hydraulic working oil for driving the track hydraulic motor 19*b* according to the pilot oil passed through the control valves 47*i* and 47*j*, and an amount of the hydraulic working oil for driving the track hydraulic motor 19*c* according to the pilot oil passed through the control valves 47*k* and 47*l*, are determined in the directional control valve 45.

In addition, two GNSS antennas 2*a* and 2*b* constituting a GNSS for calculating the position in a global coordinate system of the hydraulic excavator 100 in a work site are disposed in the vicinity of a rear side of the cab 20 at an upper portion of the upper swing structure 11. Note that in the following description, the GNSS antennas 2*a* and 2*b* may be collectively referred to as GNSS antennas 2.

The GNSS is a satellite positioning system of knowing the self-position on the earth by receiving signals from a plurality of satellites. The GNSS antennas 2 receive signals (electromagnetic waves) from a plurality of GNSS satellites (not illustrated) located above the earth, and by sending the obtained signals to a GNSS controller 53 (see FIG. 2) and performing calculation, the positions of the GNSS antennas 2*a* and 2*b* in the global coordinate system are acquired. Note that in the present embodiment, a case of calculating the position from the received signals of the two GNSS antennas 2*a* and 2*b* provided on the upper swing structure 11 is shown in the description, but this is not limitative. In other words, there are various kinds of positioning methods; for example, a technique of RTK-GNS (Real Time Kinematic-GNSS) of receiving correction information from a reference station including a GNSS antenna set in the site and acquiring the self-position more accurately may be used. In this case, the hydraulic excavator 100 need to have a receiver for receiving the correction information from the reference station, but the self-positions of the GNSS antennas 2 can be measured more accurately.

By the GNSS controller 53, the positions of the two GNSS antennas 2*a* and 2*b* in the global coordinates (positions on the earth, and, for example, information such as latitude, longitude, and altitude) are obtained. In addition, if information indicating the positions of the GNSS antennas 2 on the upper swing structure 11 is preliminarily provided, the position of the upper swing structure 11 on the earth can be obtained by inversion from the positions of the GNSS antennas 2. In addition, by measuring the respective positions of the two GNSS antennas 2*a* and 2*b*, the orientation of the upper swing structure 11, or in which direction the work implement 10 is oriented can be known.

In this way, the position, orientation, front-rear inclination and left-right inclination of the upper swing structure 11 can be known from the results of measurement by the GNSS (the GNSS antennas 2 and the GNSS controller 53) and the posture information measuring device 3*a*, and at which position on the earth and in which posture the upper swing structure 11 exists can be determined. In addition, from the dimensional information of the boom 13, the arm 14 and the bucket 15 and each rotational posture of the boom 13, the arm 14 and the bucket link 16 obtained from the posture information measuring devices 3*b* to 3*d*, the position of a bucket tip 150 of the bucket 15 relative to the upper swing structure 11 can be known. In other words, at which position on the earth and in which posture the work implement 10 including the bucket 15 exists can be determined.

Laser scanners 57*a* to 57*d* as terrain profile information measuring devices for acquiring terrain profile information in the surroundings of the hydraulic excavator 100 are disposed in the upper swing structure 11. In the present embodiment, a case where the laser scanner 57*a* for measuring the front side of the upper swing structure 11 is disposed at an upper portion of the cab 20, the laser scanner 57*b* for measuring the right side is disposed on the right side of an upper portion of the upper swing structure 11, the laser scanner 57*c* for measuring the rear side is disposed on the rear side of an upper portion of the upper swing structure 11, and the laser scanner 57*d* for measuring the left side is disposed on the left side of an upper portion of the upper swing structure 11 is shown as an example in the description. Note that in the following description, the laser scanners 57*a* to 57*d* may be collectively referred to as the laser scanners 57. The laser scanners 57 are sensors capable of measuring a three-dimensional shape of an object by applying laser light in predetermined ranges in the horizontal direction and the vertical direction, and, by the laser scanners 57 disposed respectively on the front and rear sides and the left and right sides of the upper swing structure 11, the terrain profile in the surroundings of the hydraulic excavator 100 and the shape of an object are measured. Note that in the present embodiment, a case of using laser scanners for measuring the terrain profile or the shape of an object is shown as an example in the description, this is not limitative, and a stereo camera or the like may be used insofar as similar information can be obtained.

Here, a basic operation of the hydraulic excavator 100 will be described.

In the operation of the hydraulic excavator 100, the machine controller 51 first receives an operation input from the operation lever 50, and determines in which direction and at which velocity (target velocity) each actuator (the hydraulic cylinders 18*a* to 18*c* and the hydraulic motors 19*a* to 19*c*) is to be operated. Next, the machine controller 51 determines the flow rate of the pilot oil (target pilot oil) made to flow in each part of the directional control valve 45 from the direction and the target velocity.

In this instance, the machine controller 51 has a conversion map between the pilot oil and the actuator velocity, indicating in which direction and at which velocity each actuator is operated according to the flow of the pilot oil in each part of the directional control valve 45, and, by applying this, conversion from the target velocity to the target pilot oil can be performed. When the target pilot oil is determined, the machine controller 51 adjusts the valve opening degree of one of the control valves 47 corresponding to the actuator to be operated and the direction thereof, thereby controlling such that the pilot oil flows in the target flow rate relative to the directional control valve 45.

In addition, if the control valve 47 is controlled in the valve opening degree by a current outputted from the machine controller 51, the machine controller 51 has a conversion map between current and pilot oil, indicating how much pilot oil flows according to the current made to flow on the basis of each control valve 47, and, by applying this, an output current to the control valve 47 can be determined from the target pilot oil, and the valve opening degree of the control valve 47 can be controlled such that the pilot oil passing through the control valve 47 flows at the target flow rate.

In this way, the machine controller 51, in a manned operation state, controls the valve opening degrees of the control valves 47*a* and 47*b* by a manual operation command signal generated according to an operation amount of the operation lever 50*a*, controls the valve opening degrees of the control valves 47*c* and 47*d* by a manual operation command signal generated according to an operation amount of the operation lever 50*b*, controls the valve opening degrees of the control valves 47*e* and 47*f* by a manual operation command signal generated according to an operation amount of the operation lever 50*c*, controls the valve opening degrees of the control valves 47*g* and 47*h* by a manual operation command signal generated according to an operation amount of the operation lever 50*d*, controls the valve opening degrees of the control valves 47*i* and 47*j* by a manual operation command signal generated according to an operation amount of the operation lever 50*e*, and controls the valve opening degrees of the control valves 47*k* and 47*l* by a manual operation command signal generated according to an operation amount of the operation lever 50*f*.

By such a configuration, the hydraulic excavator 100 can drive the arm 14, the boom 13, the bucket 15, the upper swing structure 11, a left crawler, and a right crawler by operating respectively the operation levers 50*a*, 50*b*, 50*c*, 50*d*, 50*e*, 50*f*, and the operator can move the machine body and perform an optional work by operating the operation levers 50.

In addition, the machine controller 51 can control also the opening and closing of the shutoff valve 46 as aforementioned. When the shutoff valve 46 is closed, supply of the pilot oil to the control valves 47 and the directional control valve 45 can be interrupted, and each actuator would not be operated; therefore, the machine controller 51 can not only control the valve opening degrees of the control valves 47, but also stop the operations of all the actuators more securely.

The GNSS antennas 2*a* and 2*b* send signals received from the GNSS satellites to the GNSS controller 53. The GNSS controller 53 calculates the positions of the GNSS antennas 2*a* and 2*b* on the earth (for example, latitude, longitude, and altitude) on the basis of the signals from the plurality of GNSS satellites, and sends the calculation result to the automatic operation controller 52. The posture information measuring devices 3*a* to 3*d*, the monitor 54, the swing angle sensor 56, the laser scanners 57, a change-over switch 58 and the like are connected to the automatic operation controller 52, in addition to the GNSS controller 53.

The posture information measuring devices 3 send the measurement results of acceleration, angular velocity and the like to the automatic operation controller 52, and, on the basis of these kinds of information, the automatic operation controller 52 calculates front-rear inclination and left-right inclination of the upper swing structure 11, rotational posture of the boom 13, rotational posture of the arm 14, and rotational posture of the bucket 15. Specifically, in regard of the measurement results of IMUs which are posture information measuring devices 3, a complementary filter or a Kalman filter or the like utilizing information such as an angle by an integrating process of angular velocity or an angle with the gravitational direction by acquisition of gravitational acceleration or the like may be used, whereby the three-dimensional angle of the IMU (posture information measuring device 3) itself relative to the gravitational direction is determined, and, by preliminarily correcting the attaching posture of each posture information measuring device 3 relative to each attaching part of the hydraulic excavator 100, rotational postures of the upper swing structure 11, the boom 13, the arm 14 and the bucket link 16 is obtained from the inclination angle of the posture information measuring device 3 itself, and rotational posture of the bucket 15 is obtained from the rotational postures of the arm 14 and the bucket link 16.

The swing angle sensor 56 is a sensor for measuring the swing angle between the upper swing structure 11 and the lower track structure 12, and a rotary encoder or the like can be used as the swing angle sensor 56. Measurement result of the swing angle sensor 56 is sent to the automatic operation controller 52, which can know the swing angle between the upper swing structure 11 and the lower track structure 12.

The laser scanners 57 measure the three-dimensional shapes of the ground surrounding the machine body, an object and the like, and transmit shape information (terrain profile information) to the automatic operation controller 52. The automatic operation controller 52 integrates the information obtained from the plurality of laser scanners 57 into single shape information on a machine body basis, on the basis of the shape information in the surroundings of the machine body obtained by the laser scanners 57 and the disposing site and disposing posture information of the laser scanners 57 relative to the upper swing structure 11. In the present embodiment, four laser scanners 57 are disposed on the upper swing structure 11, and, by integrating the information from these laser scanners 57, the terrain profile information all around the machine body can be measured. It is to be noted, however, that the number of the sensors can be reduced by using the sensors having a sufficient measurement range, and the number of the sensors may be increases for providing redundancy or the like.

The change-over switch 58 is a switch that is disposed in the cab of the upper swing structure 11 and that changes over between a manned operation state and an unmanned operation state. The change-over switch 58 is connected to the automatic operation controller 52, and the manned operation state and the unmanned operation state are changed over by the automatic operation controller 52 on the basis of a signal obtained from the change-over switch 58.

The monitor 54 is a touch panel type input-output device disposed in the cab 20 of the upper swing structure 11, and is used to input the contents of work in an unmanned automatic operation. For example, the kind of work (excavation loading, slope face forming, bumping, etc.), work range, target shape and the like can be inputted to the automatic operation controller 52 through the monitor 54.

Next, the automatic operation of the hydraulic excavator 100 will be described.

As depicted in FIG. 3, the automatic operation controller 52 has three processing sections of a recognition section 521, a state management section 522 and an operation plan section 523. In addition, the machine controller 51 has a machine control section 511.

The recognition section 521 of the automatic operation controller 52 receives information from the posture information measuring devices 3, the GNSS controllers 53, the swing angle sensor 56, and laser scanners 57 as inputs, and calculates the inclination angle, position, orientation and swing angle of the upper swing structure 11, rotational posture of each part of the work implement, terrain profile in the surroundings of the machine body, and the like. The results of calculation are sent to the state management section 522 and the operation plan section 523.

The state management section 522 receives a signal from the change-over switch 58 as an input, and the state management section 522 manages the change-over between a manned operation state and an unmanned operation state. In addition, in the unmanned operation state, the state management section 522 manages the progress status of an automatic operation work on the basis of each recognition information obtained from recognition section 521 and operation plan information obtained from the operation plan section 523, and, when the given automatic operation work is completed, the state management section 522 informs the operation plan section 523 that the automatic operation work is completed.

In an unmanned automatic operation state, the operation plan section 523 plans a specific machine body operation on the basis of the automatic operation work contents obtained from the monitor 54 and the recognition information obtained from the recognition section 521, and calculates a target operation velocity for each actuator (each hydraulic cylinder 18, each hydraulic motor 19) for executing the planned operation. For example, in the case of the contents of forming a slope face in a predetermined range as an automatic operation work, when the target slope face shape is given through the monitor 54, the lower track structure 12 is controlled to travel to the vicinity of a forming range, an operation plan for swinging the upper swing structure 11 is generated such that the upper swing structure 11 faces the target slope face, a series of operation plans for each part of the work implement 10 are generated such that the bucket tip 150 moves along the target sloe face shape, and the velocity of each actuator is generated from the operation plan.

The machine control section 511 acquires each operation amount of the operation levers 50, acquires information concerning whether the manned operation state or the unmanned automatic operation state from the state management section 522, and, in the case of the unmanned automatic operation state, acquires a target operation velocity for each actuator obtained from the operation plan section 523. In the case of the manned operation state, the machine control section 511 drives the control valves 47 so as to operate each actuator according to the operation amounts of the operation levers 50; in the case of the unmanned automatic operation state, the machine control section 511 drives the control valves 47 so as to operate each actuator according to the target operation velocities obtained from the operation plan section 523.

By such a configuration, the automatic operation controller 52 generates an operation signal (automatic operation command signal) for substituting for the operator's operation, and sends an operation command to the machine controller 51, whereby the hydraulic excavator 100 can be operated on an unmanned basis, without needing the operator's operation.

Figure 4:
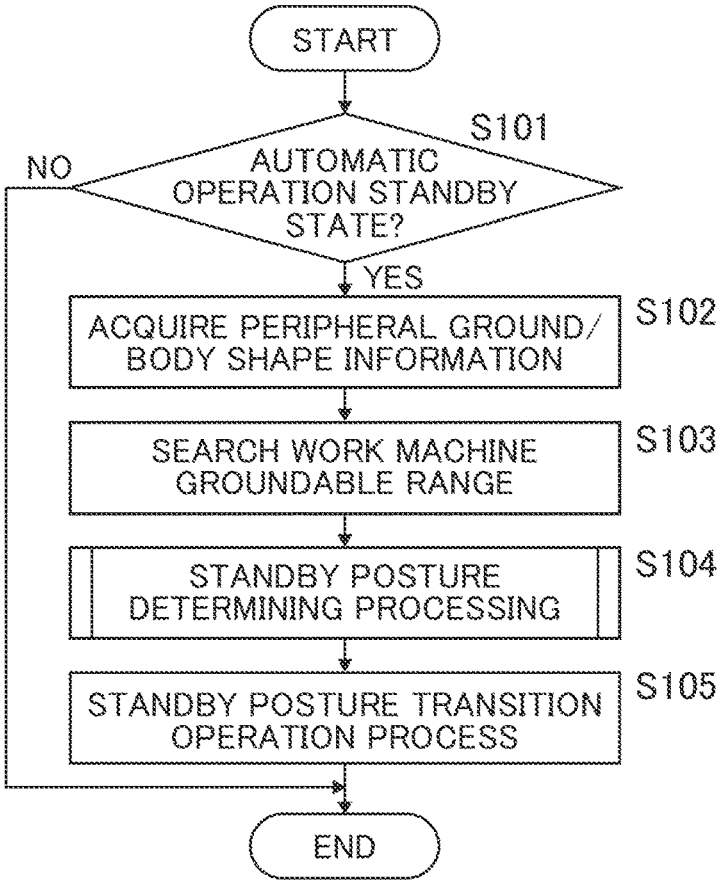
FIG. 4 is a flow chart depicting the contents of processing performed by an operation plan section at a standby time for automatic operation.
Figure 5:
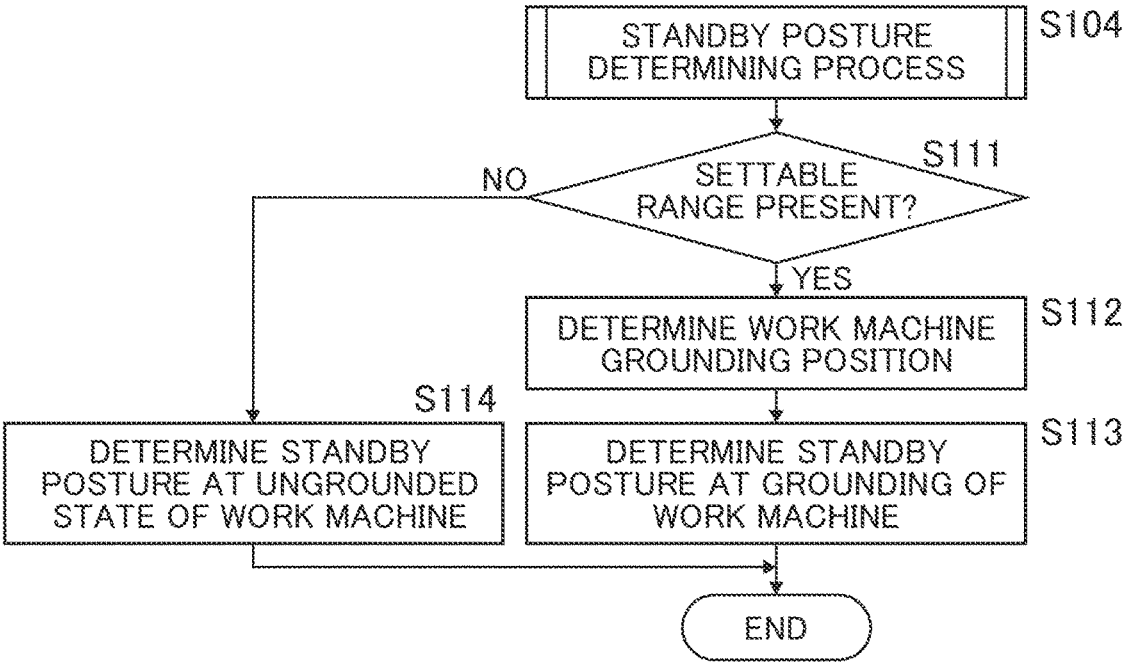
FIG. 5 is a flow chart depicting the contents of processing performed by the operation plan section at a standby time for automatic operation, and is a flow chart depicting the contents of processing of a standby posture determining process in FIG. 4.

FIGS. 4 and 5 are flow charts depicting the contents of processing performed by the operation plan section at a standby time for automatic operation, FIG. 5 being a flow chart depicting the contents of processing of a standby posture determining process in FIG. 4. In addition, FIGS. 6 to 9 are diagrams depicting respectively examples of posture of the hydraulic excavator.

In FIG. 4, the operation plan section 523 first confirms information on automatic operation work completion transferred from the state management section 522, determines whether or not the current state is an automatic operation standby state (step S101), and, when the determination result is NO, in other words, when the work is not completed, the process is finished, and automatic operation is continued.

In addition, when the determination result of step S101 is YES, in other words, when the current state is the work completion state, the shape information concerning the ground in the surroundings of the machine body and an object calculated by the recognition section 521 on the basis of the information from the laser scanners 57 is acquired (step S102).

Subsequently, a place where the work implement can contact the ground in the surroundings of the machine body is searched, on the basis of the information acquired in step S102 (step S103).

Note that a plurality of methods may be considered for searching the range in which the work implements can contact the ground. For example, the simplest method may be a method of searching a flat place where the bucket 15 can only contact the ground, from the shape information. Other method may be a method in which the automatic operation controller 52 preliminarily has current terrain profile information on the work site preliminarily measured at a site, the corresponding parts of the current terrain profile and the shape information of the ground and an object acquired are compared with each other, and, when a site where the acquired shape is increased in the height direction relative to the current terrain profile is present continuously for a predetermined range, the range is recognized to be not the ground but some obstacle, and the site is excluded from the range where the work implement can contact the ground.

In addition, not only the current terrain profile but also a map information on the work site are preliminarily given to the automatic operation controller 52, and information such as a traveling range where the machine in the site is moved is preliminarily added to the map, it can be considered that these ranges are excluded from the range where the work implement can contact the ground. In this case, the current terrain profile and the map information are preliminarily given to the operation plan section 523.

In addition, in searching the range where the work implement can contact the ground, in the case of such a range that the work implement does not reach without traveling, whether or not traveling to the position is possible (whether or not an obstacle is present in the course), and, in the case of such a range that the upper swing structure 11 must be swung, whether or not swinging to the position is possible, are also taken into consideration.

When searching of the range where the work implement can contact the ground is finished in step S103, a standby posture determining process is subsequently conducted (step S104).

As depicted in FIG. 5, in the standby posture determining process (step S104), first, whether or not the range where the work implement can contact the ground is present is determined in relation to the result of the range where the work implement can contact the ground which has been searched in step S103 (step S111).

Figure 9:
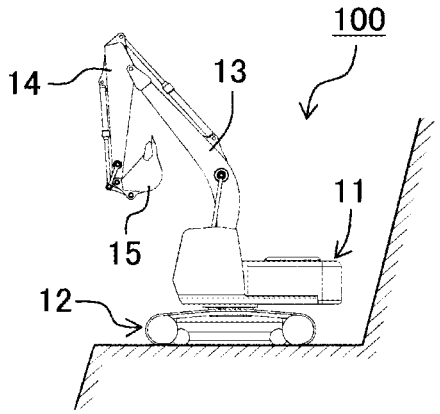
FIG. 9 is a diagram depicting an example of posture of the hydraulic excavator.

When the determination result in step S111 is NO, in other words, when it is determined in the search in step S103 that there is no range where the work implement can contact the ground, a predetermined work implement ungrounded posture is determined as the standby posture, the standby posture determining process is finished, and the control proceeds to step S105 in FIG. 4. Here, the work implement ungrounded posture is, for example, a posture such that the boom 13 is raised maximally as depicted in FIG. 9 and that the arm 14 is involved into the boom 13 side maximally, and is a posture such that the machine body is most stabilized in the condition that the work implement does not contact the ground.

In addition, when the determination result in step S111 is YES, in other words, when it is determined that a range where the work implement contacts the ground is present, a work implement grounding position is determined (step S112). The determination of the work implement grounding position is, for example, considered to set that position of the range where the work implement can contact the ground which is nearest to the current work position. In this case, the distance by which to move the work implement is minimized, and quick transition to the standby posture is possible. In addition, it is also considered that that position of the range where the work implement can contact the ground which is minimum in swing angle of the upper swing structure 11 from the current posture is made to be the work implement grounding position. In this case, the swing operation of the upper swing structure 11 is minimized, and more safe transition to the standby posture is possible.

Figure 6:
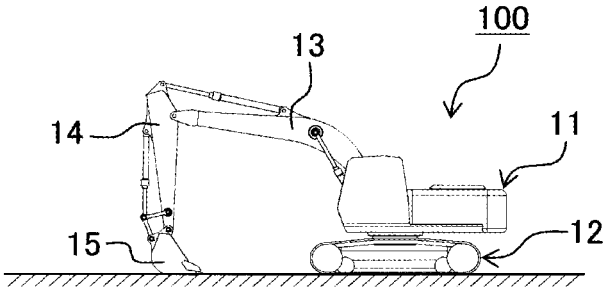
FIG. 6 is a diagram depicting an example of posture of the hydraulic excavator.
Figure 7:
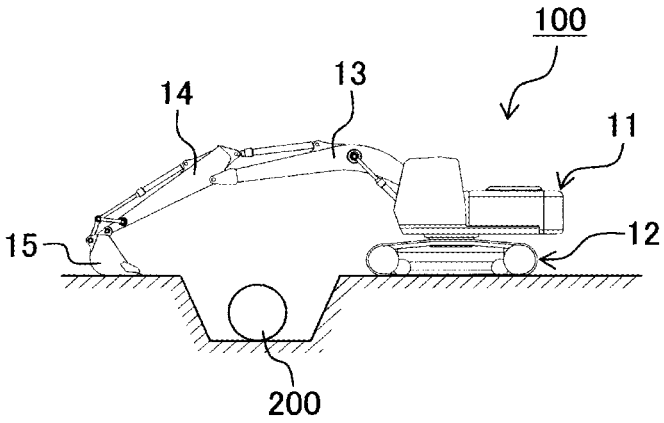
FIG. 7 is a diagram depicting an example of posture of the hydraulic excavator.
Figure 8:
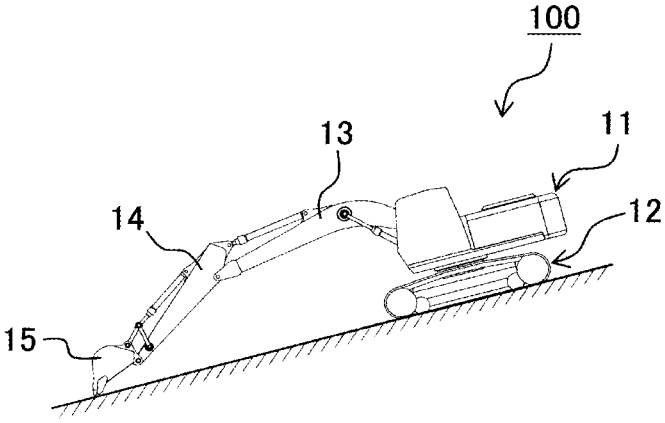
FIG. 8 is a diagram depicting an example of posture of the hydraulic excavator.

When the work implement grounding position is determined in step S112, a standby posture for causing the work implement to contact the ground at the work implement grounding position is subsequently determined (step S113), the standby posture determining process is finished, and the control proceeds to step S105 in FIG. 4. As a standby posture in work implement grounding, for example, those depicted in FIGS. 6 to 8 are considered. A basic of the standby posture in work implement grounding is a posture in which, as depicted in FIG. 6, the arm 14 is vertical and a back surface portion of the bucket 15 contacts the ground. When a sufficient range where the work implement contacts the ground is present, this posture is determined as a standby posture. When the bucket 15 cannot contact the ground in the state in which the arm 14 is vertical (for example, when an obstacle 200 such as a buried earthenware pipe is present in the course), a posture in which a back surface portion of the bucket 15 contacts the ground in the state in which the boom 13 and the arm 14 are extended forward as depicted in FIG. 7 is considered. In addition, when the ground is inclined or in other similar cases, it is considered that a posture in which the bucket tip 150 of the bucket 15 is made to be disposed to pierce the ground as depicted in FIG. 8 is the standby posture.

When the standby posture determining process in step S104 is finished, a standby posture transition operation plan for moving from the current posture to the standby posture determined in step S104 is generated and is sent to the machine control section 511 (step S105), and the process is finished.

Here, the range where grounding is possible and the procedure of determining the work implement grounding position will be described in further detail below.

A basic consideration concerning the determination of the range where grinding is possible is to consider a place flat and wider than the ground surface which the work implement contacts as a place where grounding is possible. It is to be noted, however, that one other than the ground (an obstacle or the like) and a place which is designated as a standby inhibited area in a map given from the exterior, and the like are excluded from the range where grounding is possible.

In searching of the range where grounding is possible, first, as a presumption, the hydraulic excavator 100 (automatic operation work machine) is given a work permitted area in performing an automatic (unmanned) operation, and the work machine performs an operation so as not to come out of the area (the work machine must not come out of the work permitted area). In addition, the range where grounding is possible is searched within the range measurable by the shape measuring means (in the example, the laser scanner) (searching by moving is not adopted, but if the place searched cannot be reached without moving, movement is adopted).

In this state, first, the surroundings of the work machine are scanned by the shape measuring means, to acquire a three-dimensional shape, the three-dimensional shape is classified into a part which is the ground and a part which is not the ground, and the part which is not the ground is made to be an obstacle range (procedure 1).

In addition, the area classified as the ground is further narrowed down to a range where a flat surface having a predetermined area equal to or wider than the work implement grounding surface, and the obtained range is subjected to the following process of procedure 1-1 to procedure 1-3. First, a range other than the work permitted area is excluded (procedure 1-1). Next, in regard of the area left upon procedure 1-1, when a standby inhibited area is designated, the standby inhibited area is further excluded (procedure 1-2). Further, in regard of the area left upon procedure 1-2, ranges where traveling and swinging are impossible due to an obstacle and which cannot be reached are excluded (procedure 1-3). The range left upon these procedures is determined as a range where grounding is possible.

In addition, in the determination of the work implement grounding position, in regard of the range where grounding is possible, the range where the bucket can contact the ground in a posture (for example, see FIG. 6) in which the arm is as close to vertical as possible is made to be the work implement grounding position. When there are a plurality of ranges where the arm can be vertical, a position to which a moving amount by traveling and swinging from the current posture is small is made to be the work implement grounding position; in other words, such a position as to minimize the risk attendant on movement, without much traveling or swinging, is made to be the work implement grounding position.

The effects of the present embodiment configured as above will be described.

In an automatic operation work machine, in the prior art in which only a preset standby posture is taken when the automatic operation is finished, a case is considered in which the preset standby posture may be improper according to the surrounding conditions or the standby posture cannot be taken.

In contrast, in the present embodiment, when the automatic operation is finished, a detection process of detecting the ground contactable range where the work implement 10 can contact the ground is carried out on the basis of the terrain profile information acquired by the terrain profile information measuring device (laser scanners 57), and, when the ground contactable range is detected, such an automatic operation command signal as to cause the work implement 10 to contact the ground in the ground contactable range is generated, whereas when the ground contactable range is not detected, such an automatic operation command signal as to put the work implement 10 into a predetermined standby posture is generated; therefore, a standby posture suitable for the surrounding conditions where the automatic operation is finished can be taken.

In other words, in the present embodiment, when the hydraulic excavator 100 has finished an automatic operation, the surrounding conditions are automatically recognized, an optimum standby posture is self-determined according to the conditions, thereafter, transition to the standby posture and standby are possible, and thus standby in a more stable state is realized.

Second Embodiment

A second embodiment of the present invention will be described referring to FIG. 10.

The present embodiment shows a case where the contents of processing of the standby posture determining process is different from that in the first embodiment.

Figure 10:
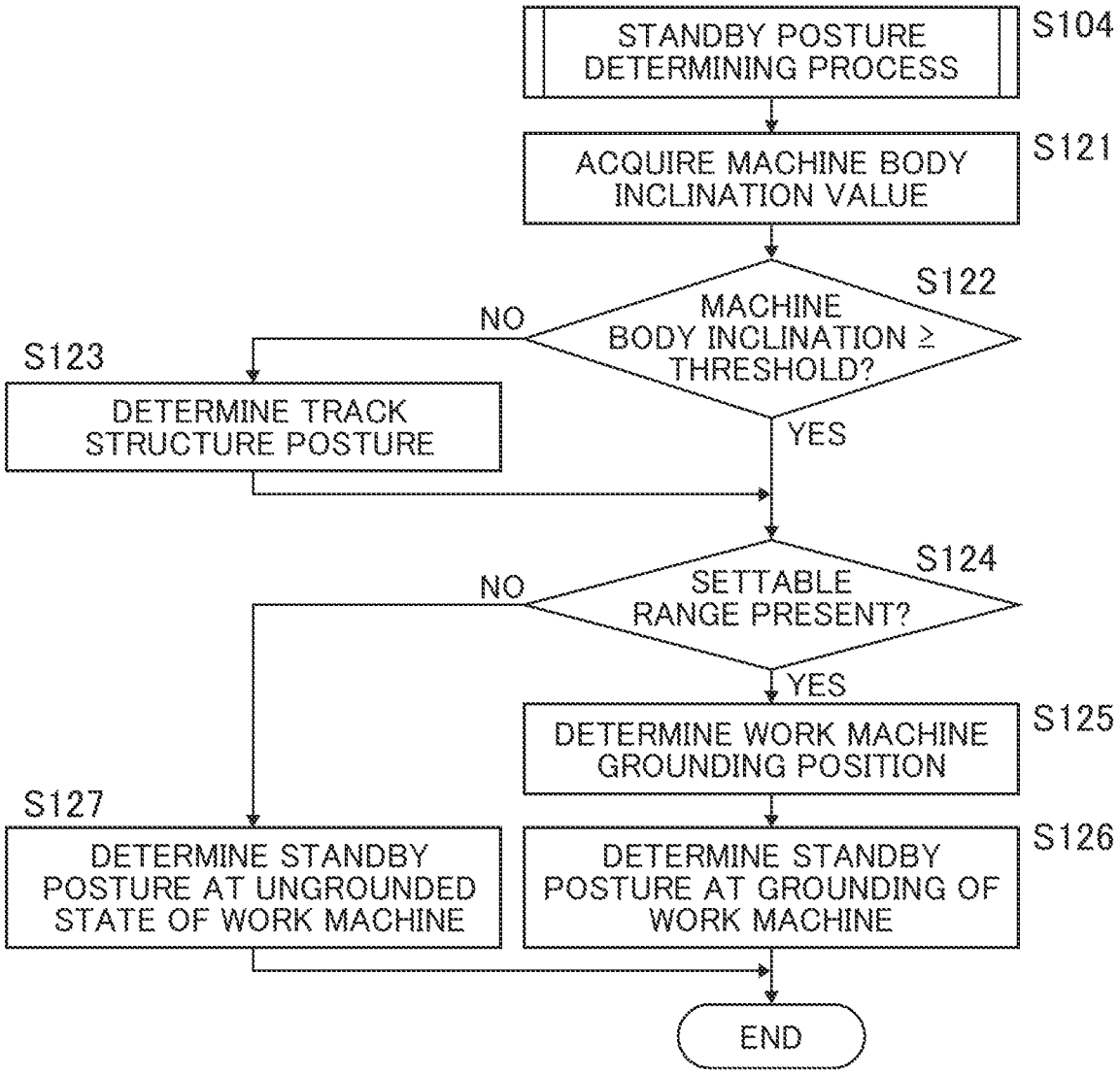
FIG. 10 is a flow chart depicting the contents of processing performed by an operation plan section at a standby time for automatic operation according to a second embodiment, and is a flow chart depicting the contents of processing of a standby posture determining process.

FIG. 10 is a flow chart depicting the contents of processing of the standby posture determining process in the present embodiment. In the figure, the same process as those in the first embodiment are denoted by the same characters as used above, and descriptions thereof are omitted.

In the standby posture determining process (step S104A, corresponding to step S104 in FIG. 4) in the present embodiment, first, a machine body inclination angle is acquired from the recognition section 521 (step S121).

Next, it is determined whether or not the machine body inclination angle is equal to or more than a threshold (step S122), and, when the determination result is YES, in other words, when the machine body inclination angle is equal to or more than the threshold, a track structure posture of the lower track structure 12 of the standby posture is determined (step S123). When the machine body is on an inclined ground, in order to more stabilize the machine body against the inclination, it is desirable to match the longitudinal direction of the crawlers of the lower track structure 12 to the inclination direction as depicted in FIG. 8, for example. Therefore, when the machine body inclination angle is equal to or more than the threshold, the track structure posture is determined in step S123 such that the lower track structure 12 is oriented in the inclination direction.

When the determination result in step S122 is NO, in other words, when the machine body inclination angle is smaller than the threshold, or when the process of step S123 is finished, the control proceeds to the processing of steps S124 to S127. Note that the processing of step S124 to S127 is a processing corresponding to step S111 to S114 in FIG. 5 in the first embodiment, so that detailed description thereof is omitted. It is to be noted, however, that when the track structure posture is already determined in step S123, a new track structure posture is not overwritten in steps S126 or S127.

In other words, in regard of consideration concerning the determination of the work implement grounding position in the present embodiment, first, when the machine body is inclined relative to the ground contactable range, movement (spin turn) is made such that the direction of the lower track structure is oriented in the inclination direction, and, in this state, it is judged whether or not the posture depicted in FIG. 8 can be taken, and, if it is impossible, the work implement grounding position is determined by the same procedure as in the first embodiment, in other words, a posture more stable against the inclination is taken.

The other configurations are similar to those in the first embodiment.

In the present embodiment configured as above, also, effects similar to those of the first embodiment can be obtained.

In addition, in the present embodiment, the standby posture on an inclined ground can be more stabilized, and the stability of the machine body can be enhanced.

Third Embodiment

A third embodiment of the present invention will be described.

The present embodiment shows a case in which the contents of processing of the standby posture determining process are different from those in the first embodiment.

In the present embodiment, with respect to the work implement grounding position determined in step S112 in FIG. 5, the standby posture determined in step S113 is a posture in which the side of the lower track structure 12 on which the hydraulic motor 19 is not mounted (hereinafter the side is referred to as the forward direction of the lower track structure) is oriented toward the work implement grounding position. With the posture inclusive of the lower track structure 12 thus determined, the upper swing structure 11 and the lower track structure 12 can be put in standby at a predetermined relative angle each time.

In the first embodiment, the direction of the lower track structure 12 is not positively changed, and, though slight track operation may be made, it is basically aimed at minimizing a track operation and a swing operation (if there is a swing operation) and to reduce the risk attendant on mechanical movement. On the other hand, in the present embodiment, it is aimed at suppressing the relative angle between the lower track structure 12 and the upper swing structure 11 to within a predetermined range.

When the respective forward directions of the lower track structure 12 and the upper swing structure 11 are thus substantially coincident with each other, where change over from the standby state to a manned manual operation is considered, a merit for the operator to easily ride into the cab, and, with the traveling direction when the track lever is tilted being the same each time, an operator's erroneous operation can be reduced.

When transition from an unmanned automatic operation to the manned manual operation, since the operator does not know the state of the machine when operated on an unmanned basis, the risk of erroneous operation is relatively raised in the beginning of the manual operation. Particularly, the traveling direction of a hydraulic excavator, in the case in which the upper swing structure 11 and the lower track structure 12 are in a swing angle relation of 0 degrees and 180 degrees, tilting the track lever in the same direction may cause reverse operations in the forward and backward directions, possibly leading to an erroneous operation.

In the present embodiment, since the forward direction of the lower track structure 12 is always directed to the work implement grounding position, it is possible to reduce the risk of erroneous operation.

In other words, as consideration concerning the determination of the work implement grounding position in the present embodiment, the work implement grounding position is determined in the same procedure as that in the first embodiment, but an operation of directing the lower track structure to the grounding direction (spin turn) after the determination is performed. As a result, the lower track structure 12 and the upper swing structure 11 are in the same direction each time, or since the relative angle is within a predetermined angle, the operator is permitted to easily ride in or get off the cab, and the direction of the track lever and the traveling direction are matched each time, thereby reducing the risk of erroneous operation.

Next, the characteristics of the above embodiments will be described.

(1) In the above embodiment, the automatic operation work machine (for example, the hydraulic excavator 100) including: the machine main body (for example, the lower track structure 12 and the upper swing structure 11): the work implement 10 mounted on the machine main body; the operation device (for example, the operation lever 50) for operation the work implement; the actuator (for example, the hydraulic cylinder 18) that drives the work implement on the basis of the manual operation command signal generated by an operation of the operation device; the posture information measuring device 3 that acquires posture information which is information concerning the posture of the work implement; and the automatic operation controller 52 that generates the automatic operation command signal for substituting for the manual operation command signal and causing the work implement to automatically perform a predetermined operation on the basis of the automatic operation command signal generated, in which the automatic operation work machine further includes the terrain profile information measuring device (for example, the laser scanners 57) that acquires terrain profile information in the surroundings of the automatic operation work machine, and the automatic operation controller, when the automatic operation is finished, performs the detection process of detecting the ground contactable range where the work implement can be placed on the basis of the terrain profile information acquired by the terrain profile information measuring device, and, when the ground contactable range is detected, generates the automatic operation command signal for placing the work implement in contact with the ground contactable range, whereas when the ground contactable range is not detected, generates the automatic operation command signal for placing the work implement into the predetermined standby posture.

As a result, a suitable standby posture according to the surrounding conditions when the automatic operation is finished can be taken.

(2) In addition, in the above embodiment, in the automatic operation work machine (for example, the hydraulic excavator 100) of (1), the machine main body includes the lower track structure 12, and the upper swing structure 11 that is provided swingably relative to the lower track structure and is swingingly operated relative to the lower track structure on the basis of the manual operation command signal or the automatic operation command signal, and the automatic operation controller 52, when the automatic operation is finished, generates the automatic operation command signal that swingably operates the upper swing structure such that the relative swing angle between the lower track structure and the upper swing structure comes into a predetermined range.

(3) In addition, in the above embodiment, in the automatic operation work machine (for example, the hydraulic excavator 100) of (2), the automatic operation work machine further includes the track operation device for operating the lower track structure, in which the automatic operation controller 52, when the automatic operation is finished, generates the automatic operation command signal for swinging the upper swing structure such that the relative angle between the operation direction of the track operation device and the traveling direction of the lower track structure by an operation of the track operation device comes into a predetermined range.

(4) In addition, in the above embodiment, in the automatic operation work machine (for example, the hydraulic excavator 100) of (1), the automatic operation work machine further includes the posture information measuring device that acquires the inclination angle and inclination direction of the machine main body as posture information, wherein the automatic operation controller 52, when the automatic operation is finished, where the inclination angle of the machine main body is outside of a predetermined range, generates the automatic operation command signal for moving the machine main body such that the relative angle in horizontal plane projection between the traveling direction of the machine main body and the inclination direction of the inclination angle comes into a predetermined range.

ADDITIONAL REMARK

Note that the present invention is not limited to the above embodiments, and includes various modifications and combination within such ranges as not to depart from the gist of the invention. In addition, the present invention is not limited to those which include all the configurations described in the above embodiments, and includes those in which part of the configurations is omitted. Besides, each of the above configurations, functions and the like may have part or whole thereof realized, for example, by designing in integrated circuit. In addition, each of the above configurations, functions and the like may be realized by software by a process in which a processor interprets and executes programs realizing the respective functions.

DESCRIPTION OF REFERENCE CHARACTERS

2*a*, 2*b*: GNSS antenna
3*a*-3*d*: Posture information measuring device
10: Work implement
11: Upper swing structure
12: Lower track structure
13: Boom
14: Arm
15: Bucket
16, 17: Bucket link
18*a*: Boom cylinder
18*b*: Arm cylinder
18*c*: Bucket cylinder
19*a*: Swing hydraulic motor
19*b*, 19*c*: Track hydraulic motor
20: Cab
41: Engine
42: Pilot hydraulic pump
43: Main hydraulic pump
45: Directional control valve
46: Shutoff valve
47*a* to 47*l*: Control valve
50*a*: Arm operation lever
50*b*: Boom operation lever
50*c*: Bucket operation lever
50*d*: Swing operation lever
50*e*, 50*f*: Track operation lever
51: Machine controller
52: Automatic operation controller
53: GNSS controller
54: Monitor
56: Swing angle sensor
57*a* to 57*d*: Laser scanner
58: Change-over switch
100: Hydraulic excavator
150: Bucket tip
200: Obstacle
511: Machine control section
521: Recognition section
522: State management section
523: Operation plan section

The invention claimed is:

1. An automatic operation work machine comprising:

a machine main body;

a work implement mounted on the machine main body;

an operation device that operates the work implement;

an actuator that drives the work implement on a basis of a manual operation command signal generated by an operation of the operation device;

a posture information measuring device that acquires posture information which is information concerning posture of the work implement; and an automatic operation controller that generates an automatic operation command signal substituting for the manual operation command signal, and performs automatic operation for permitting the work implement to automatically perform a predetermined operation on a basis of the automatic operation command signal generated, wherein the automatic operation work machine further includes a terrain profile information measuring device that acquires terrain profile information surrounding the automatic operation work machine, and the automatic operation controller, when the automatic operation is finished, performs a detection process for detecting a ground contactable range in which the work implement can be placed on a basis of the terrain profile information acquired by the terrain profile measuring device, and, when the ground contactable range is detected, the automatic operation controller generates an automatic operation command signal to place the work implement in contact with the ground contactable range, whereas when the ground contactable range is not detected, the automatic operation controller generates an automatic operation command signal to place the work implement in a predetermined standby posture.

2. The automatic operation work machine according to claim 1, wherein the machine main body includes a lower track structure, and an upper swing structure that is provided swingably relative to the lower track structure and is swung relative to the lower track structure on a basis of the manual operation command signal or the automatic operation command signal, and the automatic operation controller, when the automatic operation is finished, generates an automatic operation command signal for swinging the upper swing structure such that a relative swing angle between the lower track structure and the upper swing structure comes into a predetermined range.

3. The automatic operation work machine according to claim 2, further comprising:

a track operation device for operating the lower track structure, wherein the automatic operation controller, when the automatic operation is finished, generates an automatic operation command signal for swinging the upper swing structure such that a relative angle between an operation direction of the track operation device and a traveling direction of the lower track structure by an operation of the track operation device comes into a predetermined range.

4. The automatic operation work machine according to claim 1, further comprising:

a posture information measuring device that acquires an inclination angle and an inclination direction of the machine main body as posture information, wherein the automatic operation controller, when the automatic operation is finished, where the inclination angle of the machine main body is outside of a predetermined range, generates an automatic operation command signal for moving the machine main body such that a relative angle in horizontal plane projection between a traveling direction of the machine main body and the inclination direction of the inclination angle comes into a predetermined range.

* * * * *